US006733947B2

(12) United States Patent
De Bie et al.

(10) Patent No.: US 6,733,947 B2
(45) Date of Patent: May 11, 2004

(54) DIAGNOSTIC RADIOGRAPHIC SILVER HALIDE PHOTOGRAPHIC FILM MATERIAL

(75) Inventors: Leo De Bie, Mortsel (BE); Johan Loccufier, Zwijnaarde (BE); Ludo Joly, Hove (BE); Marc Van den Zegel, Boortmeerbeek (BE); Paul Callant, Edegem (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/609,880

(22) Filed: Jun. 30, 2003

(65) Prior Publication Data

US 2004/0009423 A1 Jan. 15, 2004

Related U.S. Application Data

(60) Provisional application No. 60/395,486, filed on Jul. 12, 2002.

(30) Foreign Application Priority Data

Jul. 5, 2002 (DE) ..... 021 00 786

(51) Int. Cl.[7] ..... G03C 1/295; G03C 5/17

(52) U.S. Cl. ..... 430/139; 430/264; 430/966

(58) Field of Search ..... 430/139, 264, 430/966

(56) References Cited

U.S. PATENT DOCUMENTS

| | | | | | |
|---|---|---|---|---|---|
| 4,385,108 | A | * | 5/1983 | Takagi et al. | 430/264 |
| 4,737,452 | A | * | 4/1988 | Kameoka et al. | 430/264 |
| 4,920,029 | A | * | 4/1990 | Inoue et al. | 430/264 |
| 5,006,445 | A | * | 4/1991 | Yagihara et al. | 430/264 |
| 5,028,510 | A | * | 7/1991 | Okamura et al. | 430/264 |
| 5,061,594 | A | * | 10/1991 | Okamura et al. | 430/264 |
| 5,965,318 | A | * | 10/1999 | Goedeweeck et al. | 430/139 |

FOREIGN PATENT DOCUMENTS

| | | |
|---|---|---|
| EP | 0 712 036 | 5/1996 |
| JP | 04163444 | 9/2002 |
| JP | 04076531 | 11/2002 |

OTHER PUBLICATIONS

European search Report, EP 02 10 0786, Nov. 22, 2002.

Patent Abstracts of Japan, Publication No. 2002131861, Sep. 5, 2002.

Database WPI, Section CH, Week 200265, XP002222112, May 9, 2002.

* cited by examiner

*Primary Examiner*—Richard L. Schilling
(74) *Attorney, Agent, or Firm*—Joesph T. Guy; Nexsen Pruet, LLC

(57) ABSTRACT

A single-side coated silver halide photographic film material has been disclosed, said film material comprising a support, at least one light-sensitive emulsion layer and a substantially light-insensitive protective hydrophilic colloid layer farther away from said support than said emulsion layer, wherein said emulsion layer contains a silver halide emulsion rich in silver bromide with cubic crystals having an average numerical diameter in the range from 0.4 up to 0.8 $\mu$m, wherein at least 95 mole % of bromide ions are present, and wherein said hydrophilic colloid layer or another substantially light-insensitive hydrophilic colloid layer essentially comprises a hydrazide represented by the general formula (I) having a silver halide adsorbing group or a masked silver halide adsorbing group; besides a method for forming a diagnostic image comprising the steps of contacting said photographic film material with an intensifying screen, forming a film/screen assembly, and exposing said assembly to X-ray radiation with an energy lower than or equal to 70 kVp, and processing said film material during a time of 90 seconds or less in a processing cycle following the steps of developing, fixing, rinsing and drying, and wherein the developing proceeds in a radiographic developer composition essentially comprising a hydroquinone and a phenidone (a 1-phenyl-3-pyrazolidine-1-one compound) as a developing agent and a heteroatomic nitro-indazol.

46 Claims, No Drawings

DIAGNOSTIC RADIOGRAPHIC SILVER HALIDE PHOTOGRAPHIC FILM MATERIAL

The application claims the benefit of U.S. provisional application No. 60/395,486 filed Jul. 12, 2002

FIELD OF THE INVENTION

The invention relates to radiographic elements containing radiation-sensitive silver halide grains intended to be exposed by an intensifying screen hit by X-rays. More particularly the said film material is a mammographic film material having a well-defined characteristic curve after rapid processing.

BACKGROUND OF THE INVENTION

The incidence of breast cancer carcinoma among women continues to increase, posing a serious health problem throughout the world. The mortality rate from breast cancer can be decreased significantly by early detection using the radiological mammography technique. With this technique the compressed breast is irradiated with soft X-rays emitted from an X-ray generating device and the modulated X-rays are detected with a radiographic X-ray conversion screen, also called intensifying screen, fluorescent screen or phosphor screen. The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box.

No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image colour and skin line perceptibility. It is common practice to set the amount of X-ray exposure so that the tissues on the inside of the breast are depicted at medium optical density values, i.e. in the optical density range from Dmin+1.0 to Dmin+2.5 (Dmin being defined as the base+fog density obtained after processing the unexposed film), and the diagnostic perceptibility of small, potentially malignant lesions in these tissues is highly determined by the contrast of the mammography film within said density range. A quantitative measure of the film contrast is the so-called average gradation, defined as the slope of the line drawn by connecting both points of the sensitometric curve of optical density vs. logarithmic exposure at which the optical density is equal to Dmin+1.0 and Dmin+2.5.

Conventional mammography films can roughly be classified in low and high contrast types according to the value of their average gradation as defined above. The low contrast type can be characterized by a relatively low average gradation ranging from 2.0 to 2.5 whereas the average gradation of the high contrast type may range from 3.0 to 3.5. Often, high contrast films are preferred because of the higher ability to detect tiny cancers deep in the glandular tissue of the breast. If the contrast is too high, however, it may preclude visualisation of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach is described in U.S. Pat. No. 5,290,665.

In order to extend the exposure latitude some manufacturers have introduced high contrast mammography films characterized by a higher maximum density (hereinafter referred to as Dmax) than conventional high contrast films, e.g. a Dmax equal to at least 3.7, preferably even higher than 4.0. However, a film characterized by a higher Dmax is only a minor improvement with regard to better skin line perceptibility, since the background density is too high for the skin line to be clearly visible. Indeed at optical density values above 3.5, the local gradient, i.e. the slope of the sensitometric curve must be very high in order to guarantee a reasonable perceptibility as described in the classic article 'Determination of optimum film density range for r öntgenograms from visual effect' by H. Kanamori (Acta Radiol. Diagn. Vol.4, p. 463, 1966). Nevertheless, mammography films with a higher Dmax are appreciated by a growing number of radiologists because of the wider dynamic range, i.e. the density range Dmax–Dmin of the mammogram. An important progress has been brought about with respect to perceptibility of the skin line in U.S. Pat. No. 5,965,318 but attaining a perfect balance of the characteristic curve after processing between contrast in the low densities (in order to avoid steeping up of said contrast) and contrast in the high densities (in order to avoid flattening of that contrast) remains an ever lasting demand.

As is known from graphic art materials nucleating agents provide ability to get hard dots and high contrasts in line materials, known as the commonly termed "lith quality" in processing cycles wherein the traditional "lith developers" are characterized by the presence of hydroquinone as the sole developing agent and a low but critical sulphite ions content which gives rise to an infectious development mechanism, as was described by Yule in The Journal of the Franklin Institute, Vol. 239, p. 221–223, (1945). In more recent times so-called "hard dot Rapid Access" developers were introduced on the market which combine a good stability with a "lith quality" in the reproduction of lines and screen dots, wherein examples of such developers and corresponding appropriate photographic materials include the GRANDEX system, marketed by FUJI PHOTO ltd., AGFASTAR, marketed by AGFA-GEVAERT N.V. and the ULTRATEC system, marketed by EASTMAN KODAK Co. Some of these systems make use of the contrast promoting action, induced by a nucleating mechanism, of hydrazine derivatives known for long time in the photographic art. As described in U.S. Pat. No. 4,650,746, use of a hydrazine compound permits use of an auxiliary development agent in combination with the hydroquinone type of developing agent so that the development capacity can be increased. It also permits the presence of a relatively high sulphite concentration in order to protect the developer against aerial oxidation, thus prolonging its effective working life.

A practical, early recognized problem with hydrazine compounds was caused by the high pH levels needed for the developers containing said hydrazine compounds or used with photographic elements containing these compounds in order to get the maximum effect on contrast. The teaching of Nothnagle in U.S. Pat. No. 4,269,929 provided a solution for this problem: a method for high contrast development was disclosed involving a hydrazine compound, either in the photographic element or in the developer, said developer further containing a hydroquinone developing agent, a 3-pyrazolidinone developing agent, sulphite ions, and a "contrast-promoting amount" of an amino compound and in a preferred embodiment the hydrazine compound was incorporated in the photographic material. This particular combination of ingredients allowing use of a rather moderate alkaline pH for the developing solution while retaining the desired high contrast, high developing capacity and long effective life of the developer was intensively worked out further in the context of graphic applications, inclusive for materials for micrography, but was never applied in radiographic diagnostic materials as e.g. mammography. Intense research in the context of graphic applications has, more particularly conducted to specific new hydrazide derivatives and an important technological breakthrough has been realized by the development and use of sulphonamido-arylhydrazides as disclosed in EP-A 0 286 840 and U.S. Pat. No. 5,104,769, which proved to be a very reactive and effective type.

Another main progress was the use of hydrazides, especially sulphonamido-arylhydrazides in combination with so-called "incorporated boosters", such as disclosed in U.S. Pat. No. 4,975,354, providing incorporation of said "boosters" into the photographic material itself instead of into the developer in order to get desired contrast effects.

OBJECTS AND SUMMARY OF THE INVENTION

It is an object of the present invention to provide a class of active hydrazide nucleating agents suitable for use in high contrast silver halide photographic materials, differing from materials for graphic arts applications with improved gradation, image quality (sharpness) and exposure latitude, more particularly in diagnostic radiographic materials as e.g. mammographic materials.

It is a further object of the present invention to provide a photographic material suitable for use in rapid processing applications.

The present invention thus extends the teachings on hydrazine compounds in photographic silver halide materials, more in particular in radiographic diagnostic image materials wherein such compounds were never used before, but wherein a high, well-defined contrast in differing density parts of the characteristic curve is desired in view of image definition. The objects of the present invention have been realized by providing a radiographic diagnostic silver halide photographic film material comprising a support and, on one side thereof, as hydrophilic layers, at least one emulsion layer, overcoated with a protective antistress layer, characterized in that said antistress layer or another substantially light-insensitive hydrophilic colloid layer contains a hydrazide compound as set out in claim 1 and in the claims dependent thereupon in order to provide a characteristic curve showing well-defined contrast differences after processing in the presence versus in the absence of said hydrazide compound.

The above-mentioned advantageous effects have more particularly been realized by providing a silver halide photographic material for mammography provided with specific hydrazide compounds having the specific features set out in preferred embodiments of the invention as in the dependent claims.

As a result, use of the well-defined class of hydrazide compounds as described in the material of the present invention provides the desired influence of contrast or gradient over the whole sensitometric curve.

More particularly said effect is obtained when a light-sensitive hydrophilic layers is coated from cubic crystals rich in silver bromide, having silver iodide in a molar amount of less than 5%, wherein said cubic grains have average cubic edges in the range from 0.4 up to 0.8 $\mu$m.

Particularly desired contrasts of more than 4.0 and, even more preferred, of more than 4.5 are attained for single-side coated light-sensitive layer, preferably spectrally green-sensitized emulsion crystals, particularly suitable for use in mammographic applications in combination with a green light emitting intensifying screen.

The effect obtained by application of the present invention is moreover most clearly expressed after processing of the material exposed in a film/screen arrangement, more preferably in a developer having minor amounts of 5-nitro-indazol (but no benzimidazol).

DETAILED DESCRIPTION OF THE INVENTION

The terms "front" and "back" used herein are referring to radiographic imaging are used to designate locations nearer to and farther from, respectively, the source of X-radiation than the support of the radiographic element.

The term "single-side coated" refers to a radiographic element coating format in which radiation-sensitive silver halide grains are coated on only one side of a support, whereas "duplitized" or "double-side coated" refers to coatings on both sides of said support.

The term "overall processing" refers to processing that occurs between the time an image-wise exposed element is introduced into a processor and the time the element emerges dry. The processing steps include development, fixing, washing and drying and the term "rapid access processing" refers to overall processing in less than 90 seconds.

The term "percent swelling degree" means that the hydrophilic colloid layers of a radiographic element are forehardened in an amount sufficient to reduce swelling of these layers to less than a certain percent swelling being determined by (a) incubating the radiographic element at 38° C. for 3 days at 50% of relative humidity, (b) measuring layer thickness, (c) immersing the radiographic element in demineralized water at 21° C. for 3 minutes, and (d) determining the percent change in layer thickness as compared to the layer thickness measured in step (b).

The term "substantially light insensitive hydrophilic colloid layer" means that the light-sensitivity of that layer is at least a factor of 10 lower than that of the light-sensitive emulsion layer.

A single-side coated silver halide photographic film material is thus disclosed herein, said film material comprising a support, a light-sensitive emulsion layer and a substantially light-insensitive protective hydrophilic colloid layer farther away from said support than said emulsion layer, wherein said emulsion layer contains a silver halide emulsion rich in silver bromide with silver halide crystals having an average numerical diameter in the range from 0.4 up to 0.8 $\mu$m, wherein at least 95 mole % of bromide ions are present, and wherein said hydrophilic colloid layer or another substantially light-insensitive hydrophilic colloid layer comprises a hydrazide represented by the general formula (I)

(I)

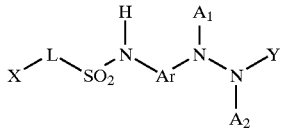

wherein Y is selected from the group consisting of

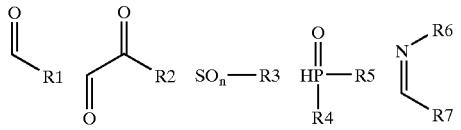

wherein $R^1$ to $R^7$ is selected from the group consisting of hydrogen, $NR^8R^9$, $OR^{10}$, $SR^{11}$, a substituted or unsubstituted saturated or unsaturated aliphatic group, a substituted or unsubstituted aromatic group, and a substituted or unsubstituted heteroaromatic group, and wherein $R^8$ to $R^{11}$ each independently represents a member selected from the group consisting of hydrogen, a substituted or unsubstituted, saturated or unsaturated aliphatic group, a substituted or unsubstituted aromatic group, a substituted or unsubstituted heteroaromatic group and wherein $R^4$ and $R^5$, $R^6$ and $R^7$ and $R^8$ and $R^9$ respectively may have the necessary atoms in order to form a ring;

n equals an integer having a value of 1 or 2;

$A_1$ and $A_2$ each independently represents hydrogen, a group capable of yielding a hydrogen upon alkaline hydrolysis, or $R^{12}SO_2$, provided that, if $A_1$ represents $R^{12}SO_2$, $A_2$ represents hydrogen or vice versa, that $R^{12}$ represents a substituted or unsubstituted saturated or unsaturated aliphatic group, a substituted or unsubstituted aromatic group, a substituted or unsubstituted heteroaromatic group; and that further Ar represents a substituted or unsubstituted aromatic or heteroaromatic group;

L represents a divalent linking group; and X represents a silver halide adsorptive group or a group capable of yielding a silver halide adsorptive group upon processing.

It is essential for the present invention that X is a silver halide absorbing group or a masked silver halide group, providing a silver halide absorbing group upon processing.

In order to obtain a satisfactory image resolution, mammography films comprise one or more light-sensitive emulsion layer(s) on only one side of a transparent support, which is typically a blue coloured polyethyleneterephtalate film having a thickness of 175 μm. Preferably one or more backing layer(s), which operates as anti-halation and anti-curl layer, are present on the opposite side of said support, although an antihalation layer my be even more useful with respect to sharpness at the light-sensitive side of the support, e.g. between the subbing layer and the emulsion layer or between a gelatin layer covering said subbing layer and the emulsion layer. One or more subbing layers may be coated directly on the support to improve the adhesion of the emulsion and backing layer(s) to the support. In addition, an undercoat layer between the emulsion and subbing layer(s) and a protective layer on top of the emulsion layer(s) may be present. Additional non light-sensitive intermediate layers are optional. In favour of anti-curling properties after processing as disclosed in EP-A 1 148 379, in the backing layer of a single-side coated light-sensitive silver halide photographic film material, at the non-light sensitive side of the support, a backing layer, covered with a protective outermost layer is advantageously present, wherein at least said backing layer is provided in at least one layer thereof, besides a cross-linked or cross-linkable first binder, with an organic component free from cross-linking upon reaction with a hardener, as a second binder, wherein said organic component is a polymer selected from the group consisting of dextran having a molecular weight of not more than 20000 and polyacrylamide having a molecular weight not more than 20000.

The light-sensitive emulsion layer(s) of the photographic materials according to the present invention comprise(s) a silver bromoiodide emulsion with silver halide crystals having an average numerical diameter between 0.4 and 0.8 μm and wherein at least 95 mole % of bromide ions are present. In a preferred embodiment, in favour of ease of manufacturing cost, only one light-sensitive emulsion layer is present.

The grain size can be determined using conventional techniques, e.g. as described by Trivelli and Smith, The Photographic Journal, vol. 69, 1939, p.330–338, Loveland "ASTM symposium on light microscopy" 1953, p.94–122 and Mees and James "The Theory of the photographic process" (1977), Chapter II. The silver halide grains are obtained by conventional precipitation techniques which are well known in the art and consist of the addition of aqueous solutions of silver and halide salts, e.g. silver nitrate and sodium, potassium or ammonium halide, to a solution comprising a protective colloid.

In a preferred embodiment, the light-sensitive emulsion layer(s) of the material according to the present invention comprise(s) cubic silver bromoiodide grains containing less than 5 mole % of silver iodide, preferably less than 3 mole % and even more preferably at most 1 mole %. The class of so-called cubic grains embraces (a) perfectly cubic crystals, or (b) cubic crystals with rounded corners, or (c) cubic crystals with small (111) faces at the corners (also known as tetradecahedrical grains), the total area of these (111) faces however being small compared to the total area of the (100) faces. Moreover a cubo-octahedral shape is not excluded and the actual morphology of the grains obtained depends on the pAg values applied during the precipitation. Preferred methods for the precipitation of cubic grains are the pAg-balanced double- or triple-jet methods as described in the EP-A's 712,036 and 610,609, since these methods provide monodispersed emulsions characterized by a narrow grain size distribution defined in that at least 95% by weight or number of the grains have a diameter within about 40%, preferably within about 30% of the average grain size and more preferably within about 10% to 20%. The variation coefficient of the emulsion grains according to this invention has preferably a low value of between 0.15 and 0.20, and still more preferably of 0.10, said variation coefficient being defined as the ratio between the standard deviation of the grain size and the average grain size.

Although the silver halide grains of the present invention may comprise chloride, bromide or iodide and any combination thereof, the preferred cubic emulsion crystals comprise silver bromoiodide grains having an average iodide content of at most 1 mole %, wherein the iodide distribution can be homogenous over the whole crystal volume or may be present as a so-called core-shell crystal structure, i.e. a silver halide crystal having distinct phases characterized by a different iodide to bromide ratio. More than one shell can be present and between different phases it can be recommended to have a phase enriched in silver iodide by applying the so-called conversion technique during precipitation. Iodide ions can be provided by adding aqueous solutions of inorganic salts thereof as e.g. sodium, potassium or ammonium iodide; by adding organic compounds which are capable of releasing iodide ions as described in the EP-A's 0 561 415; 0 563 701; 0 563 708; 0 649 052 and 0 651 284 or even by adding ultrafine homogeneous silver iodide crystals having an average diameter of about 50 nm or even less. Presence of silver iodide up to an amount of at most 1 mole %, more preferably with at least 0.1 mole %, based on silver, whether homogeneously distributed over the cubic crystal volume or heterogeneously (e.g. as a core-shell emulsion or as a silver bromide crystal having all iodide at the crystal surface) is strived at. Presence of dopants (e.g. metal dopants as e.g. SET's—metal dopants acting as "shallow electron traps") is not required but is not excluded either, not as addendum providing contrast-enhancement, but, if required, as addendum providing less intensity reciprocity failure.

The precipitation of the silver halide crystals according to the present invention is performed in the presence of a protective, hydrophilic colloid, e.g. conventional lime-treated or acid treated gelatin but also oxidized gelatin or a synthetic peptizer may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium. Cubic silver halide grains may also be precipitated in the absence of gelatine by making use of colloidal silica as a protective colloid, in the presence of an onium compound, as described in EP-A's 0 677 773 and 0 649 051.

In order to control the grain size, grain growth restrainers or accelerators may be used during the precipitation or the flow rate or concentration of the silver and halide salt solutions, the temperature, pAg, physical ripening time, etc. may be varied. Silver halide solvents such as ammonia, a thioether compound, thiazolidine-2-thione, tetra-substituted thiourea, potassium or ammonium rhodamide and an amine compound may be present during grain precipitation in order to adjust the average grain size. At the end of the precipitation the emulsion is made free from excess of soluble inorganic salts by a conventional washing technique e.g. flocculation by ammonium sulphate or polystyrene sulphonate, followed by one or more washing and redispersing steps. Other well-known washing techniques are dialysis or ultrafiltration. Finally, extra gelatin can be added to the emulsion in order to obtain a gelatin to silver ratio which is optimized with respect to the coating conditions and/or to establish the required thickness of the coated emulsion layer. Preferably a gelatin to silver halide weight ratio ranging from 0.3 to 1.0 is then obtained.

The silver halide emulsions may be chemically sensitized according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitisation can be carried out by effecting the ripening in the presence of small amounts of compounds containing sulphur, selenium or tellurium or a combination thereof; e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds are applied in combination with a noble metal salt, preferably a gold complex salt, but also salts of platinum, palladium and iridium as described in U.S. Pat. No. 2,448,060 and GB-P 618,061 may be used. The amount of gold, used in the chemical ripening of emulsions according to the present invention, is preferably in the range of 25 to 45 ppm vs. the amount of metallic silver. Additions of sulphur, selenium, tellurium or combinations thereof and gold may be carried out consecutively or simultaneously. In the latter case the addition of goldthiosulphate, goldselenosulphate or gold-tellurosulphate compounds may be recommended. Optionally, small amounts of compounds of Rh, Ru, Pb, Cd, Hg, or Tl can be added. Also reductors may be added as chemical sensitizers as e.g. tin compounds as described in GB-Patent 789,823, amines, formamidinesulphinic acids, and silane compounds. The chemical sensitisation can also proceed in the presence of phenidone and/or its derivatives, a dihydroxybenzene as hydroquinone, resorcinol, catechol and/or a derivative(s) thereof, one or more stabilizer(s) or antifoggant(s), one or more spectral sensitizer(s) or combinations of said ingredients.

The silver halide grains present in a mammography film are spectrally sensitized in order to optimally detect the light emitted from the X-ray conversion screen. A preferred mammography film is characterized by a spectral sensitivity ranging from 5 to 80 $\mu J/m^2$ measured at the emission maximum of the X-ray conversion screen, said spectral sensitivity being defined herein as the amount of exposure to light of a given wavelength required to obtain an optical density Dmin+1.0 after processing.

The silver halide emulsion can be spectrally sensitized by adding one or several cyanine dyes, merocyanine dyes, complex cyanine dyes, complex merocyanine dyes, hemicyanine dyes, styryl dyes and hemioxonol dyes. Preferred examples of suitable orthochromatic spectral sensitizers are 5,5'-dichloro-3,3'-bis($SO_3$—R)-9-ethylbenzoxacarbocyanines with R being n-propylene or n-butylene. Furthermore, green-light absorbing spectral sensitizers according to the formulae given in JP-A's 06-035104; 06-035101; 06-035102; 62-191847; 63-249839; 01-312536; 03-200246; U.S. Pat. No. 4,777,125 and DE 3,819,241 may be used. The right choice of said sensitizers or combinations thereof is always related to the purpose of obtaining the highest possible photographic speed while reducing dye stain after processing as e.g. in EP-A 1 246 000. Another survey of useful chemical classes of spectral sensitizers is described by F. M. Hamer in "The Cyanine Dyes and Related Compounds", 1964, John Wiley & Sons and other examples have been given in Research Disclosure Item 22534 and in EP-A 0 757 285.

Other dyes, which per se do not have any spectral sensitisation activity, or certain other compounds, which do not substantially absorb visible radiation, can have a supersensitisation effect when they are incorporated together with said spectral sensitising agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as azaindene compounds.

At least one non-spectrally sensitising dye can be added to an emulsion layer or to one or more non-light-sensitive hydrophilic layers such as the backing layer(s). The presence of such dye(s) in adapted amounts is not only recommended to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersions of water insoluble dyes having a mean particle diameter of less than 10 $\mu$m, more preferably less than 1 $\mu$m and still more preferably less than 0.1 $\mu$m. Examples of such dyes are disclosed in EP-A's 0 0 274 723, 0 276 566, 0 323 729, 0 351 593, 0 384 633, 0 586 748 0 587 230, 0 656 401, and in U.S. Pat. Nos. 4,900,653; 4,904,565; 4,949,654; 4,940,654; 4,948,717; 4,988,611; 4,803,150 and 5,344,749. Said dyes can also be added in the form of a solid silica particle dispersion as disclosed in EP-A's 0 569 074. Still another technique to obtain ultra fine dye dispersions consists in acidifying a slightly alkaline coating composition "in situ" just before coating it onto the supporting layer.

The silver halide emulsions according to the present invention may also comprise compounds preventing the formation of a high minimum density or stabilising the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 17643 (1978), Chapter VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitisation and development acceleration.

Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0,634,688 and 0,674,215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy-(meth)acrylates, glycidyl (meth)acrylates, (meth)acrylamides, vinyl esters, acrylonitriles, olefins and styrenes, or copolymers of the above with acrylic acids, methacrylic acids, .alpha.-.beta.-unsaturated dicarboxylic acids, hydroxyalkyl (meth) acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 46-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 $\mu$m. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708. Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group. The photographic material may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex and the like.

It is an essential feature of the present invention to add specific hydrazide compounds to a substantially non-light sensitive layer, more preferably to the protective antistress layer of the mammographic material of the present invention, in order to fully reach the objects of the present invention. More specifically, hydrazides having as specific characteristic presence of a so-called "silver-anchor" on a p-sulfonamido-substituted hydrazide are providing excellent results with respect to speed, contrast and image definition (sharpness) if added to the said protective antistress of the mammographic film material of the present invention.

In a preferred embodiment said particular hydrazides set forth hereinbefore are most effective when having an oxalylamide group.

Hydrazides having a "non-masked silver-anchor" show superior results when compared with hydrazides carrying a "masked silver-anchor".

It was shown that selecting the hydrazide solely for the balance between hydrophilic and hydrophobic properties did not (or to a low extent) give the desired result. The use of hydrazides not carrying a silver-anchor showed no or a very limited effect on the desired sensitometric properties or on image quality. Those hydrazides clearly seemed to offer inferior results if compared with para-sulfonamido substituted hydrazides, as e.g. with respect to speed at low densities (in the toe-part of the sensitometric curve) where contrast was too low, just as in the shoulder party at the highest densities.

A single-side coated silver halide photographic film material, according to the present invention thus comprises a support, at least one light-sensitive emulsion layer and a substantially light-insensitive protective hydrophilic colloid layer farther away from said support than said emulsion layer, wherein said emulsion layer contains a silver halide emulsion rich in silver bromide with cubic crystals having an average numerical diameter in the range from 0.4 up to 0.8 $\mu$m, wherein at least 95 mole % of bromide ions are present, and wherein said hydrophilic colloid layer or another substantially light-insensitive hydrophilic colloid layer comprises a hydrazide represented by the general formula (I) given hereinafter, and combines thereby the desired characteristics as set out hereinbefore.

Characteristic within the scope of the present invention is that it comprises in its protective antistress layer a hydrazide of the general formula (I)

(I)

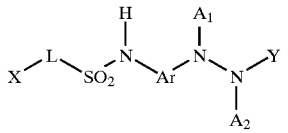

wherein Y is selected from the group consisting of

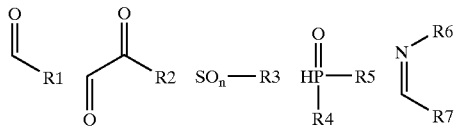

wherein $R^1$ to $R^7$ is selected from the group consisting of hydrogen, $NR^8R^9$, $OR^{10}$, $SR^{11}$, a substituted or unsubstituted saturated or unsaturated aliphatic group, a substituted or unsubstituted aromatic group, and a substituted or unsubstituted heteroaromatic group, and wherein $R^8$ to $R^{11}$ each independently represents a member selected from the group consisting of hydrogen, a substituted or unsubstituted, saturated or unsaturated aliphatic group, a substituted or unsubstituted aromatic group, a substituted or unsubstituted heteroaromatic group and wherein $R^4$ and $R^5$, $R^6$ and $R^7$ and $R^8$ and $R^9$ respectively may have the necessary atoms in order to form a ring;

n equals an integer having a value of 1 or 2;

$A_1$ and $A_2$ each independently represents hydrogen, a group capable of yielding a hydrogen upon alkaline hydrolysis, or $R^{12}SO_2$, provided that, if $A_1$ represents $R^{12}SO_2$, $A_2$ represents hydrogen or vice versa, that $R^{12}$ represents a substituted or unsubstituted saturated or unsaturated aliphatic group, a substituted or unsubstituted aromatic group, a substituted or unsubstituted heteroaromatic group; and that further Ar represents a substituted or unsubstituted aromatic or heteroaromatic group;

L represents a divalent linking group;

X represents a silver halide adsorptive group or a group capable of yielding a silver halide adsorptive group upon processing.

In a further preferred embodiment, the photographic material according to the present invention comprises a hydrazide according to general formula (II) hereinafter

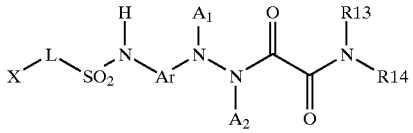

wherein $R^{13}$ and $R^{14}$ are independently selected from the group consisting of a hydrogen, a substituted or unsubstituted saturated or unsaturated aliphatic group, a substituted or unsubstituted aromatic group, a substituted or unsubstituted heteroaromatic group. $R^{13}$ and $R^{14}$ may represent the necessary atoms to form a ring;

$A_1$ and $A_2$ each independently represents hydrogen, a group capable of yielding hydrogen upon alkaline hydrolysis or $R^{12}SO_2$, provided that if $A_1$ represents $R^{12}SO_2$, $A_2$ represents hydrogen or vice versa;

$R^{12}$ represents a substituted or unsubstituted saturated or unsaturated aliphatic group, a substituted or unsubstituted aromatic group, a substituted or unsubstituted heteroaromatic group;

Ar represents a substituted or unsubstituted aromatic or heteroaromatic group;

L represents a divalent linking group; and

X represents a silver halide adsorptive group or a group capable of yielding a silver halide adsorptive group upon processing.

In an even more preferred embodiment in the general formulae (I) and (II) each of $A_1$ and $A_2$ represent hydrogen and at least one of $R^{13}$ and $R^{14}$ represents an aliphatic group containing a hydroxyl or an amino group. In the most preferred embodiment according to the present invention, X represents a heterocyclic thion.

Typical examples of hydrazides according to the present invention are given below in the formulae A to Q, without however being limited thereto.

A

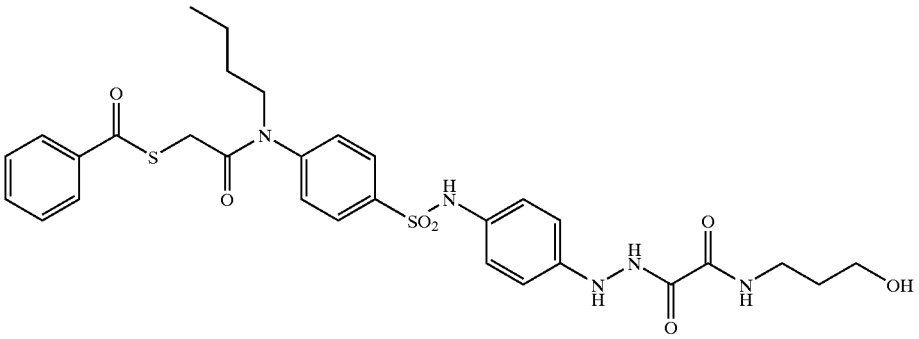

B

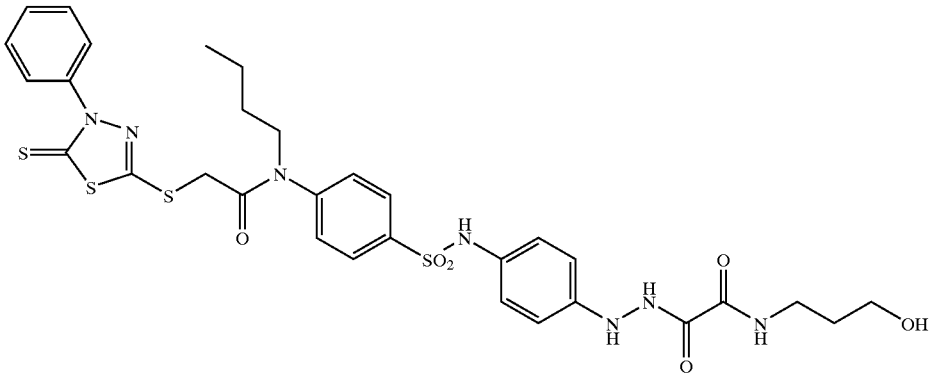

C

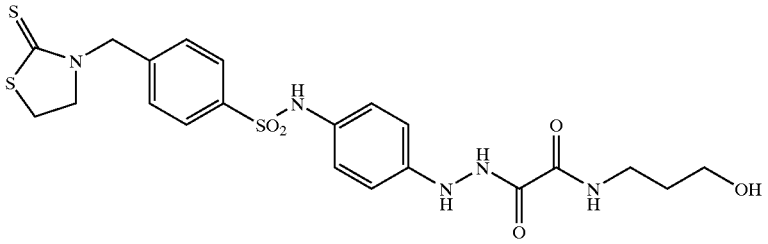

-continued
D
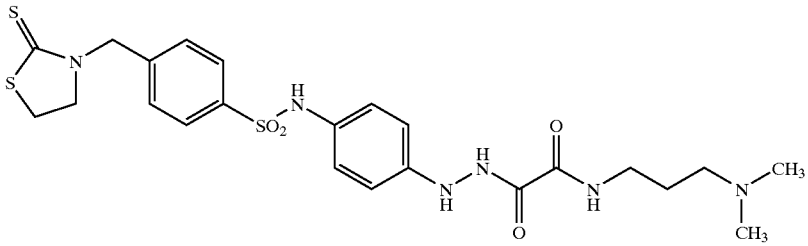
E
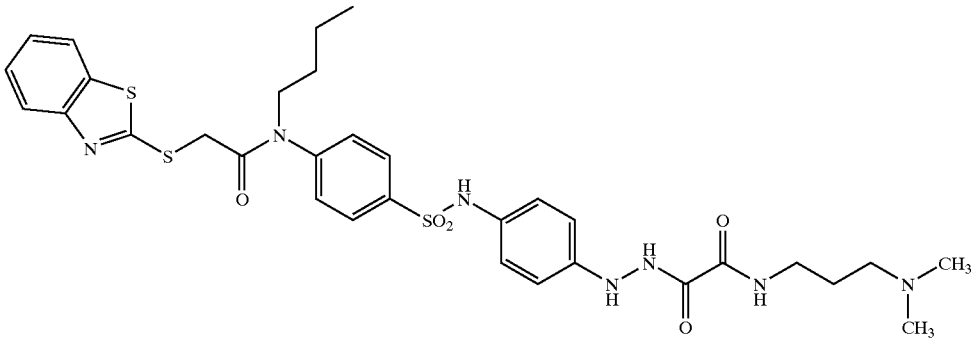
F
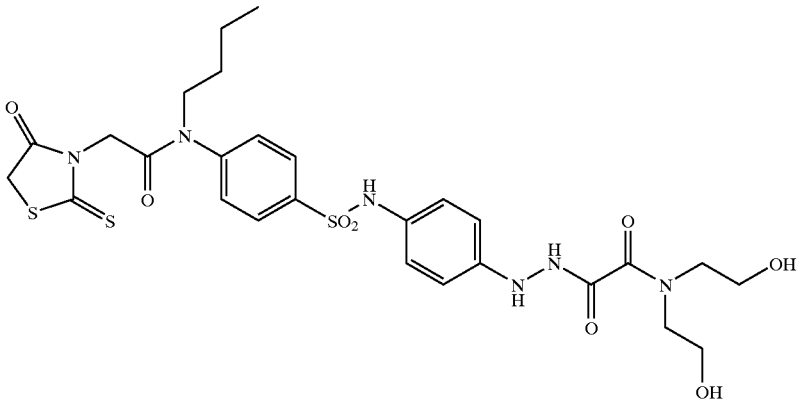
G
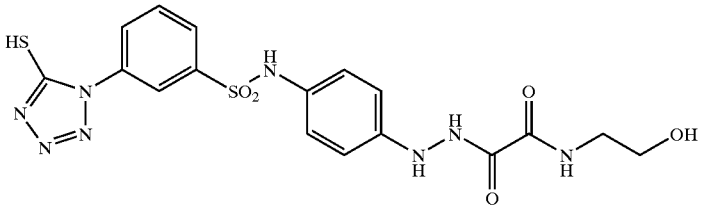
H
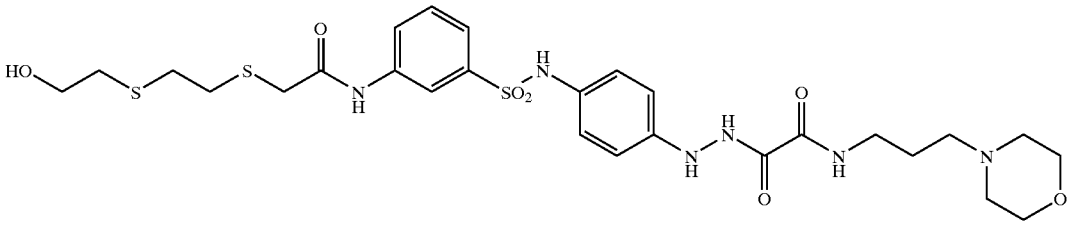

-continued
I
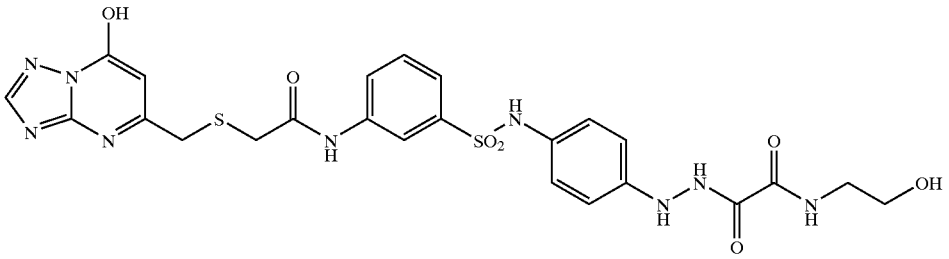
J
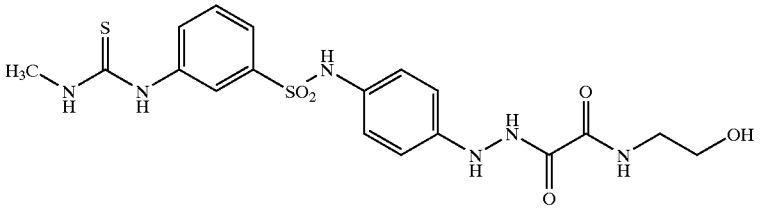
K
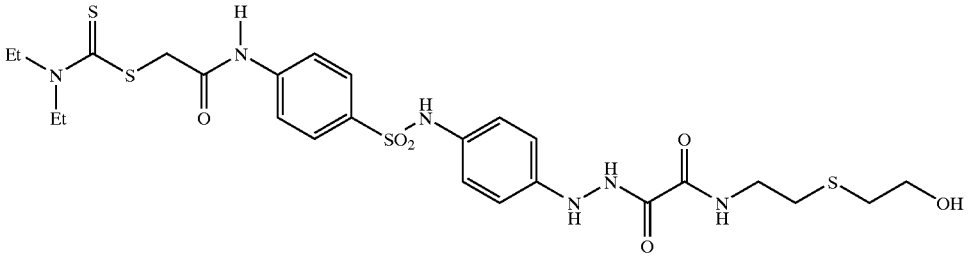
L
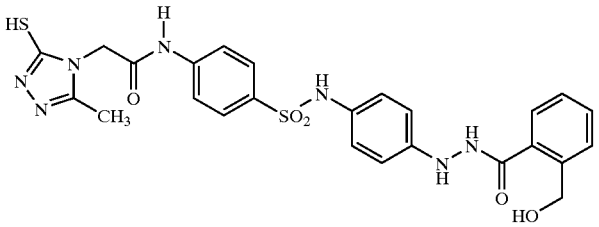
M
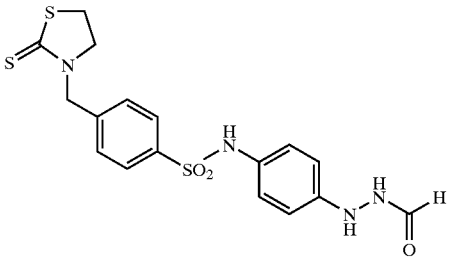
N
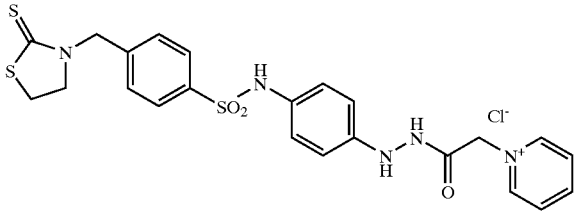
O
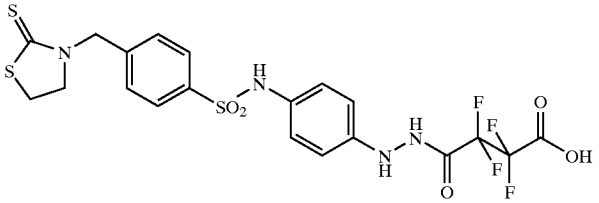
Q
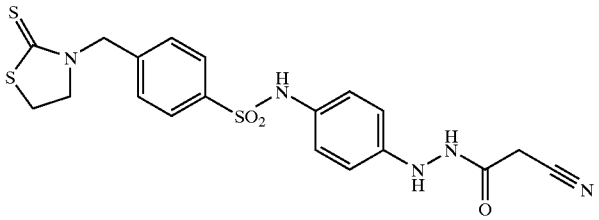
P
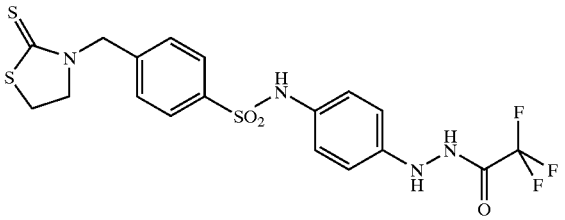

-continued
R
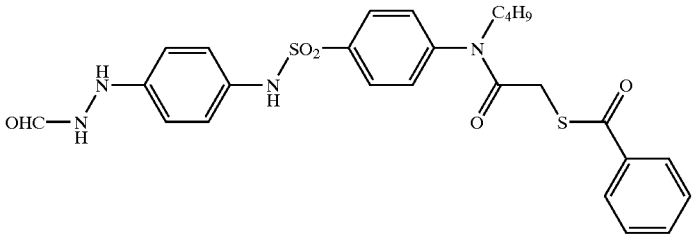
S
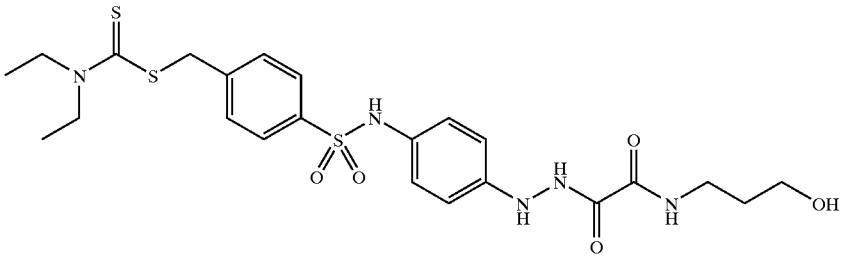
T
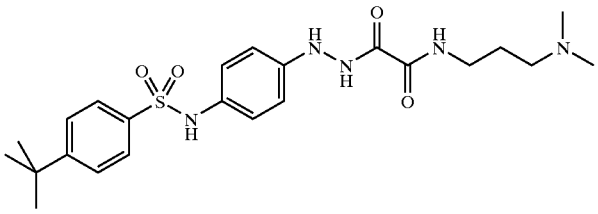
U
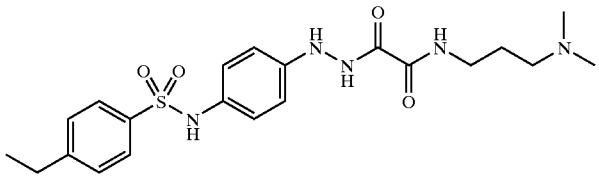
V
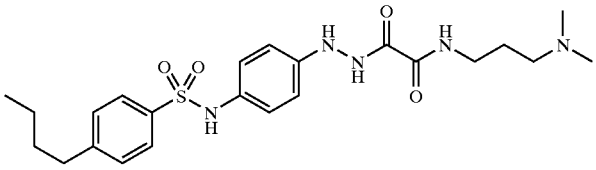
W
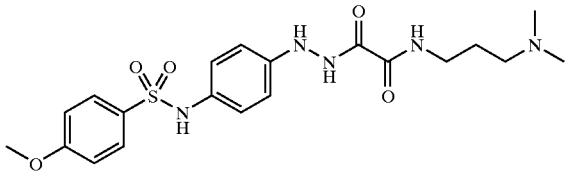
X
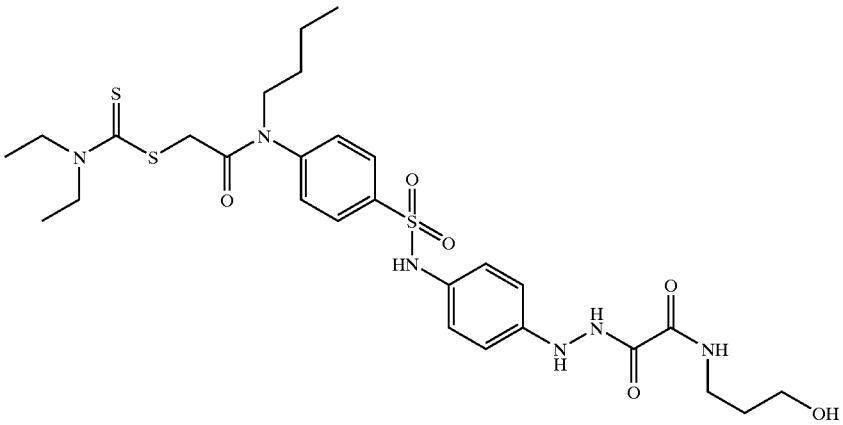

-continued

Y

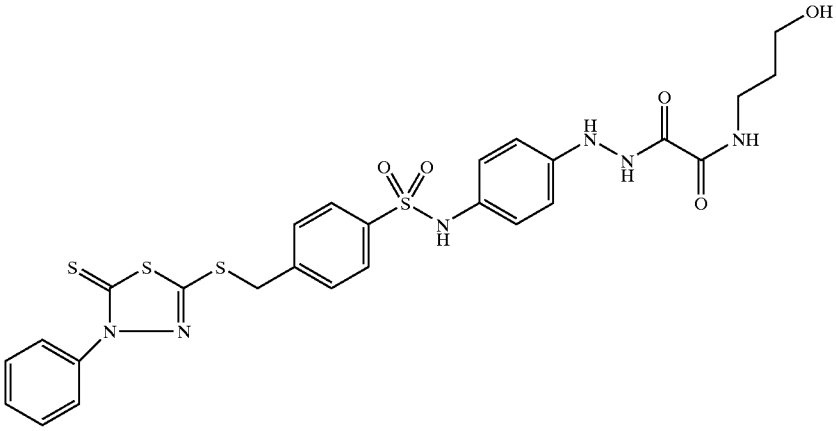

Z-1

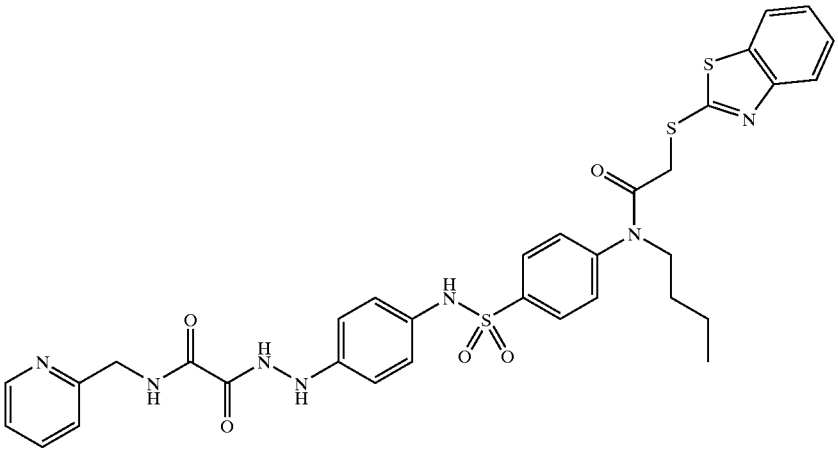

Z-2

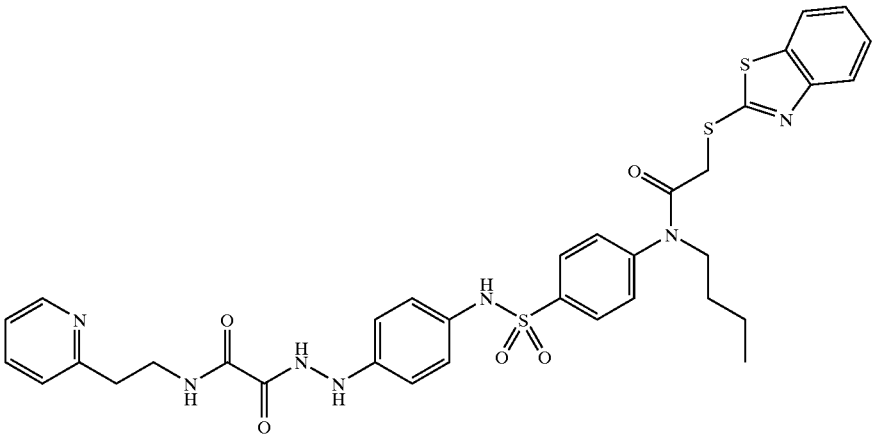

In a further preferred embodiment apart for the hydrazide compounds present in the photographic material according to the present invention, presence of boosters moreover reinforces the advantageous effect obtained. A significant effect with respect to both desired speed and desired contrast or gradation is obtained.

According to the present invention a method has further been provided for forming a diagnostic image comprising the steps of providing a single-sided photographic film comprising a support, an emulsion layer and a hydrophilic colloid layer farther away from said support than said emulsion layer contacting said photographic film with an intensifying screen, forming a film/screen assembly, and exposing said assembly to x-ray radiation with an energy lower than or equal to 70 kVp, processing within a time of at most 90 seconds dry-to-dry in a cycle comprising the steps of developing, fixing, rinsing and drying, wherein the developer wherein the developing proceeds in a radiographic developer composition essentially comprising a hydroquinone and a 1-phenyl-3-pyrazolidine-1-one compound as developing agents, and a heteroatomic nitro-indazol compound.

With respect to processing it has been proved that in developers free from benzimidazole compounds, free from a nitro-substituent, the most satisfying results are attained.

As a result of the presence of a hydrazide compound in the protective antistress layer of the mammographic film material of the present invention, a gradation (contrast) increase in the shoulder area (high density range) of the sensitometric curve is measured, whereas no or a negligible increase is measured in the toe area (low density range), opposite to the commonly stated effect on graphic art materials, showing a much steeper increase of contrast in the toe area versus in the shoulder area of the corresponding sensitometric curve.

Accordingly use has been made of the material according to the present invention for obtaining diagnostic images in medical applications, for images of an object under investigation in low voltage imaging environments and for industrial radiography of low-density structures, and, more preferably for obtaining mammographic diagnostic images.

A silver halide photographic film material has thus been disclosed comprising on one side of a subbed support as hydrophilic colloidal layers a spectrally (green light) sensitized light-sensitive silver halide emulsion layer coated with silver, expressed as an equivalent amount of silver nitrate in the range from 5.00 g/m$^2$ up to 7.50 g/m$^2$ and, farther from said support than said emulsion layer, a protective antistress layer, characterized in that by presence in the said antistress layer (or another substantially light-insensitive hydrophilic colloid layer) of a specific hydrazide compound according to the general formulae (I) or (II) given above, a ratio in the range from 1:2 to 1:10 has been calculated, versus in the absence of said hydrazide compound, with respect to percentage contrast increase in the toe area to contrast increase in the shoulder area of the sensitometric curve obtained after exposure of said film material in contact with an intensifying screen to X-rays having an energy in the range from less than 40 kVp up to 70 kVp and processing during 90 seconds in a processing cycle following the steps of developing, fixing, rinsing and drying, and wherein the radiographic developer composition essentially comprises hydroquinone and a phenidone as developing agents. In an even more preferred embodiment presence as a nitro-compound in the developer of a nitro-indazol or a nitro-benzimidazol compound (and absence of a benzimidazol compound as such) is highly recommended.

Said toe contrast is the slope of a line drawn between a characteristic curve first reference point at a density of 0.85 above minimum density and a second, lower exposure reference point on the characteristic curve separated from the first reference point by an exposure difference of 0.3 log E, whereas said shoulder contrast is the slope of a line at the point where log E equals SP+0.8 (SP being defined as the log E at which the optical density equals Dmin+1.0), where log E is the log of exposure in lux-seconds. Although having been described with respect to use in single-side coated film materials, and, more specifically to mammographic materials, use in duplitized or double-side coated materials is not excluded, wherever appropriate. So at least in a layer arrangement as disclosed in EP-A 1 246 005, in at least one substantially light-insensitive hydrophilic colloid layer hydrazides disclosed in the context of the present invention may be very suitable for use. The image-forming layer arrangement in the mammographic material disclosed therein is comprised of layer units permeable for aqueous processing solutions, said layer units being a hydrophilic front layer unit coated on the said front major face of the support wherein the front layer unit is capable of reaching a maximum density of more than 3.00; a hydrophilic back layer unit coated on the said back major face of the support; wherein sensitivity (speed), measured at a density of 0.50 above fog, is higher for the front layer unit than for the back layer unit in an amount of from 0.70 up to 1.70 log (Exposure); characterized in that both the front layer unit and the back layer unit have one or more light-sensitive silver halide emulsion layer(s) coated with emulsion crystals, essentially having a cubic crystal habit.

It is even not excluded, in order to reach whatever an object (as e.g. contrast increase, speed enhancement) in a photographic material wherein hydrazides according to the general formulae (I) and (II), to make use of tabular silver halide grains, known as crystals possessing two parallel (111) faces with a ratio of the diameter of a circle having the same area as these faces versus the thickness, being the distance between the two major faces, equal to at least 2.

While the present invention will hereinafter be described in connection with preferred embodiments thereof, it will be understood that it is not intended to limit the invention to those embodiments.

EXAMPLES

Example 1

Hydrazide 1:
Intermediate 1:

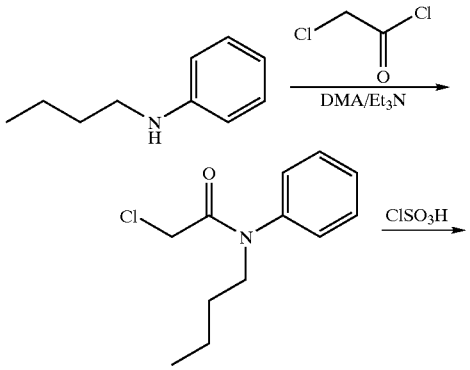

-continued

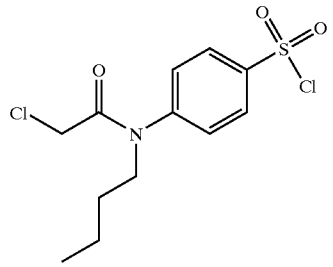

Acylation:

400 g (2.68 mole) of n.-butylaniline were dissolved in 1200 ml dimethylacetamide. 298 g (2.95 mole) triethyl amine were added and the mixture was cooled to 5° C. 333.7 g (2.95 mole) chloroacetyl-chloride was added over three hours. The reaction mixture was stirred at 10° C. for an additional two hours. TLC analysis showed an incomplete conversion. 10 mole % triethylamine and chloroacetyl-chloride were added and the reaction was allowed to continue for an additional hour. Upon complete conversion, the reaction mixture was poured into 2500 ml of water and extracted with 1100 ml of methylene chloride. The methylene chloride was extracted three times with a 20% sodium carbonate solution. The methylene chloride was filtered over a layer silicagel and dried over magnesium sulfate. The methylene chloride was evaporated under reduced pressure. The oily residu was redissolved in 1000 ml of hexane and extracted three times with 1000 ml water. The organic layer was dried over magnesium sulfate and the solvent was removed under reduced pressure. 604 g of an oily compound was isolated.

Chlorosulfonylation:

810 ml of chlorosulfonic acid was added slowly to 550 g (2.44 mole) of n-butyl chloroacetanilide. The reaction mixture was heated to 100° C. for 20 hours. After cooling down to room temperature, the reaction mixture was poured into 7 l of ice and 1 l of water. 2 l of methylene chloride were added and the isolated methylene chloride fraction was extracted with 1 l of 20% sodium carbonate and 1 l of water. The methylene chloride fraction was dried over magnesium sulfate. The methylene chloride is filtered over 500 g silicagel. The silicagel was washed with an additional liter of methylene chloride. The pooled organic fractions were evaporated under reduced pressure and the oily residu was crystallized with 500 ml of cyclohexane. 384 g of the sulfochloride was isolated.

Intermediate 2:
acylation:

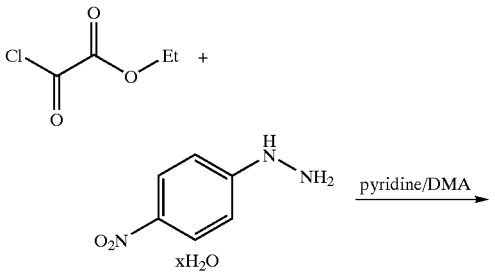

-continued

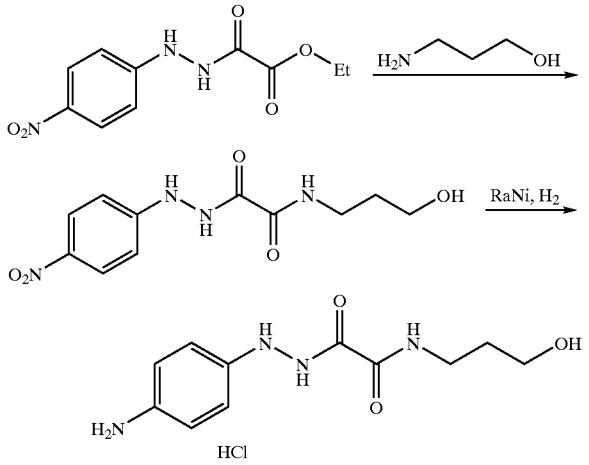

588 g (3.8 mole) of 4-nitrophenyl hydrazine hydrate were dissolved in 850 ml of dimethyl acetamide. The mixture was dried over magnesium sulfate and 387 g (4.9 mole) of pyridine were added. The mixture was cooled to 0° C. and 596.8 g (4.37 mole) of ethyloxalyl-chloride were added slowly while keeping the temperature at 0° C. The reaction was allowed to continue over night at room temperature. The reaction mixture was poured into 5 l of water and the mixture was stirred for 30 minutes. The precipitated compound was isolated by filtration, washed twice with 500 ml of water and dried. 565 g of the intermediate ethyloxalyl-4-nitro-phenylhydrazide were isolated.

Aminolysis:

540 g (2.13 mole) of ethyloxalyl-4-nitro-phenylhydrazide were suspended in 3000 ml of ethanol. 176 g (2.34 mole) of 3-aminopropanol were added and the mixture was refluxed for 15 hours. 1.5 liter of ethanol was removed by distillation and the reaction mixture was allowed to cool down to room temperature. 2 liter of ethylacetate and 2 liter of isopropylacetate were added. The precipitated product was isolated by filtration, washed with ethylacetate and dried under reduced pressure. 393 g of the intermediate hydroxypropyl-oxalyl-amido-4-nitro-phenylhydrazide was isolated.

Reduction:

80 g (0.29 mole) of the nitrohydrazide were dissolved in 500 ml of dimethylacetamide. 45 g (0.57 mole) of pyridine were added and the nitrohydrazide was hydrogenated at 60° C. over Raney Nickel. After one and half an hour, the hydrogenation was complete. The dimethylacetamide solution of the hydrazide could be used as such or the hydroxypropyl-oxalylamido-4-amino-phenylhydrazide could be isolated as chlorohydrate. A typical procedure has been given below.

The dimethylacetamide solution isolated after hydrogenation, containing 0.29 mole of aminohydrazide, was cooled to 10° C. and 48 ml of a concentrated hydrochloric acid solution were added. To this mixture, 50 ml of ethanol and 350 ml of ethylacetate were added and the chlorohydrate was allowed to crystallize over night. Intermediate 2 was isolated by filtration, re-dispersed in 50 ml of ethanol and 400 ml of ethylacetate, isolated again by filtration and dried.

Precursor hydrazide 1:

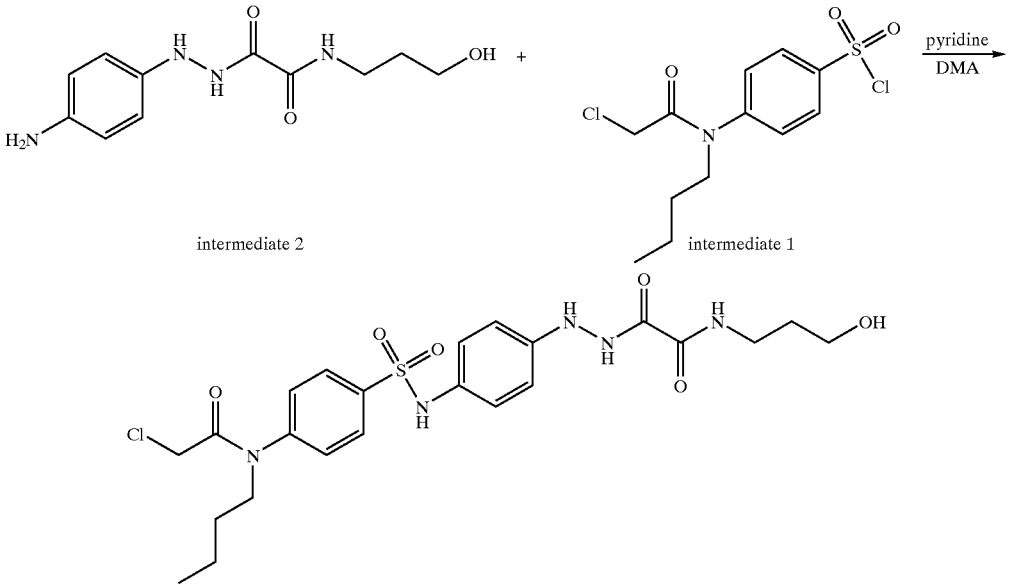

46 g (0.14 mole) of intermediate 1 were dissolved in 100 ml of dimethylacetamide and added drop-wise to a solution of 39.5 g (0.14 mole) of hydroxypropyl-oxalylamido-4-amino-phenylhydrazide (intermediate 2) in dimethylacetamide. Intermediate 2 was used without isolation as chlorohydrate. As a consequence, the dimethylacetamide solution still contained pyridine. The conversion was monitored by TLC. Upon complete conversion, the addition of the sulfochloride intermediate 1 was stopped. The reaction mixture was poured into 2 liter of water. The precursor hydrazide precipitated as an oily residue. The oily residue was isolated and the precursor hydrazide 1 was purified by preparative column chromatography (eluent:methylene chloride/methanol 93/7). 34 g of precursor hydrazide 1 were isolated.

Hydrazide 1:

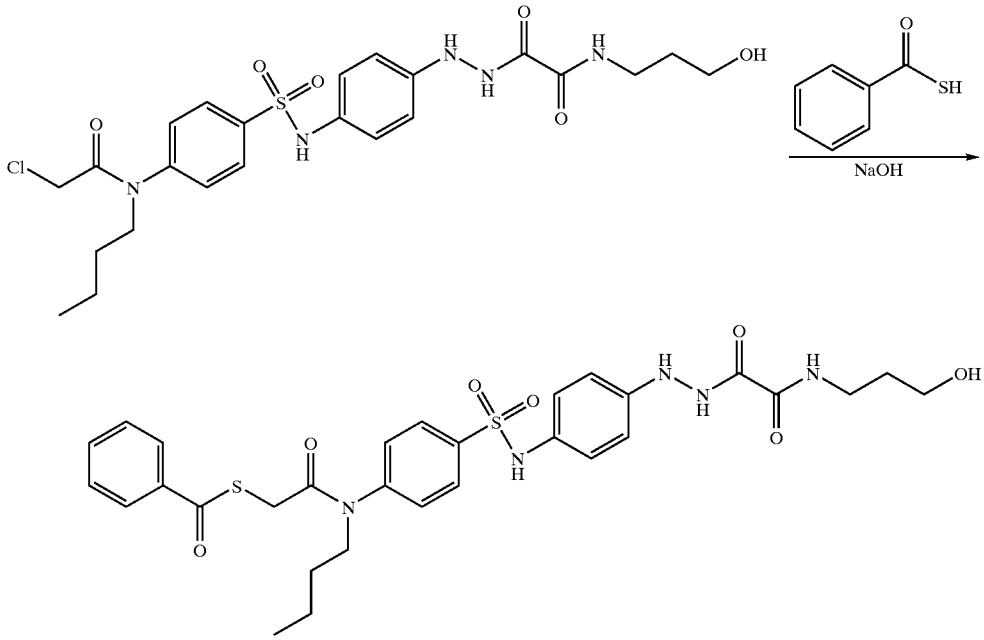

4 g (7.4 mmole) of precursor hydrazide 1 were suspended in 20 ml of ethanol. A solution of 1.12 g (8.14 mmole) of thiobenzoic acid and 0.33 g (8.14 mole) of NaOH in 20 ml ethanol were added and the reaction was allowed to continue for 24 hours. Upon completion of the reaction, 100 ml water were added and hydrazide 1 precipitated as a white solid.

Hydrazide 1 was isolated by filtration, washed with water and dried under reduced pressure. 4.2 g of hydrazide 1 were isolated.

Example 2

Hydrazide 2

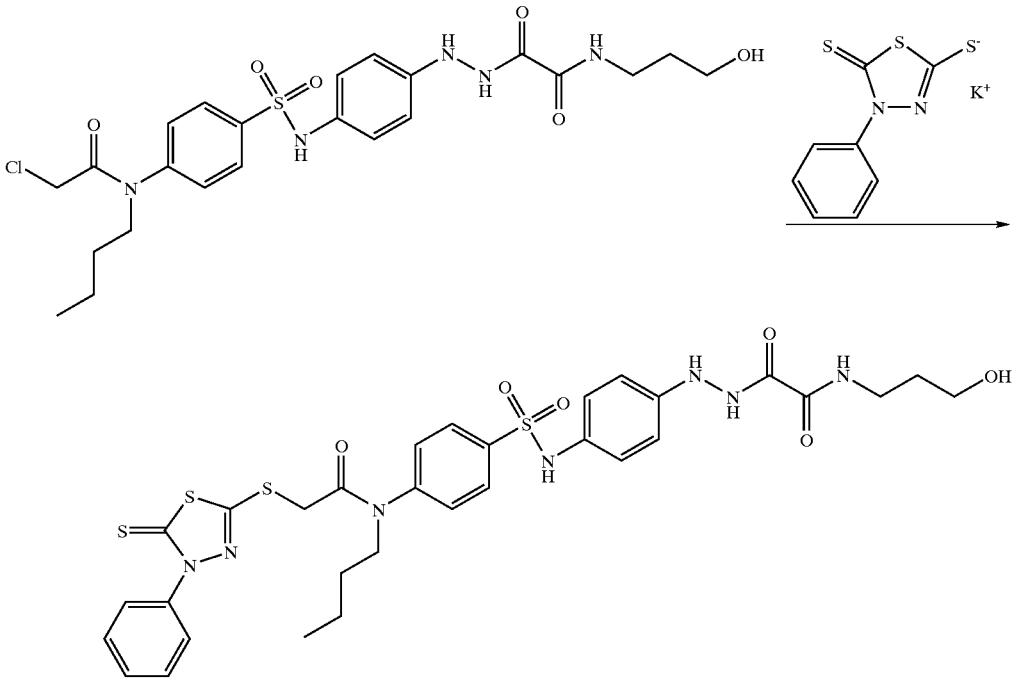

2.16 g (4 mmole) of precursor hydrazide 1 were dissolved in 25 ml dimethylacetamide. 1.26 (4.8 mmole) 2-mercapto-4-phenyl-1,3,4-thiadiazole-5-thion potassium salt were added and the reaction was allowed to continue for 8 hours at room temperature. The reaction mixture was poured into 500 ml water and hydrazide 2 precipitated from the medium. Hydrazide 2 was isolated by filtration, treated twice with 800 ml of methyl-tert. butyl ether, redissolved in acetone and precipitated in methyl tert. butyl ether-isopropylacetate 1/1. Finally 1 g of hydrazide 2 was isolated.

Example 3

Hydrazide 3

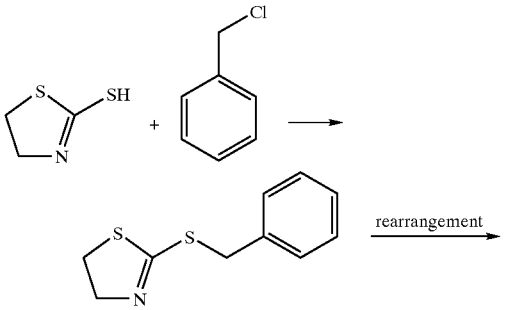

-continued

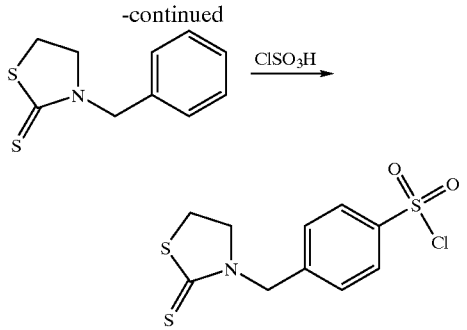

Intermediate 3:

2-mercapto-thiazoline was conventionally alkylated, using one equivalent sodium methanolate in methanol and one equivalent benzyl chloride. The rearrangement of the obtained 2-benzylthio-thiazoline is described below.

12.7 g (0.1 mole) of benzylchloride were added to 209.2 g (1 mole) of 2-benzylthio-thiazoline and the mixture was heated to 150° C. for eight hours. The mixture was allowed to cool down to 70° C. and 500 ml of methanol were added. The reaction mixture was allowed to cool down to room temperature and stirred for an additional hour; N-benzyl-thiazoline-thion precipitated from the medium as a white crystalline product, was isolated by filtration and washed twice with 10 ml of methanol. The crude product was recrystallized from a minimum of acetonitrile. 146 g of N-benzyl-thiazolinethion were isolated and sulfonated as described below.

83.7 g (0.4 mole) of N-benzyl-thiazoline-thion were dissolved in 560 ml of methylene chloride and added to 132 ml of chlorosulfonic acid, heated to 65° C. The rate of addition was adjusted to the rate of distillation of methylene chloride. The sulfonation was allowed to continue for 3 hours at 60° C. The reaction mixture was allowed to cool down to room temperature and 1 l of methylene chloride was added. The methylene chloride was extracted with a solution of 282 g of $Na_2HPO_4.2H_2O$ in 1900 ml of water. The aqueous solution of $Na_2HPO_4.2H_2O$ had to be added very carefully. The methylene chloride was extracted again with 1 l of 2N NaOH and with 200 ml of a 25% sodium chloride solution. The methylene chloride was concentrated to 150 ml and 500 ml of methyl tert. butyl ether were added. The crude intermediate 3 precipitated as an oily product, that solidified on stirring. 61 g of a crude sulfochloride were isolated and recrystallized from 90 ml of acetonitrile. Finally, 31 g of intermediate 3 were isolated.

Hydrazide 3:

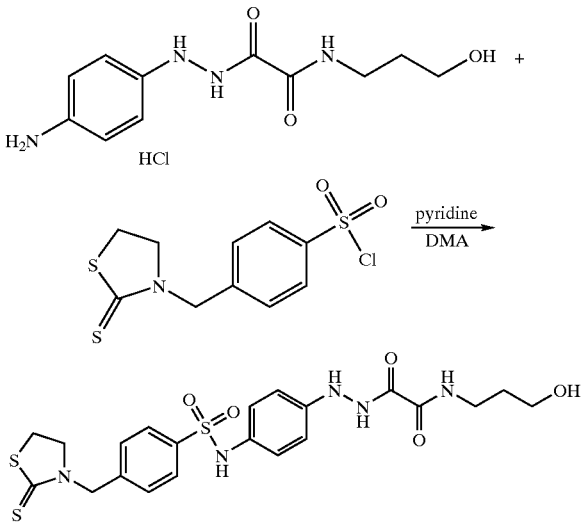

26.5 g (86 mmole) of intermediate 3 and 24.8 g (85 mmole) of intermediate 2 (as chlorohydrate) were dissolved in 250 ml of dimethyl acetamide. 14.95 g (189 mmole) of pyridine were added and the reaction was allowed to continue at 60° C. for three hours. After cooling down to room temperature, the reaction mixture was poured into 1.5 liter water. The oily residue was isolated and redissolved into 1-methoxy-2-propanol. The solution was precipitated again in water. This treatment was repeated twice and finally hydrazide 3 could be crystallized with some difficulties. 23 g of hydrazide 3 were isolated.

Example 4

Hydrazide 5 intermediate 4:

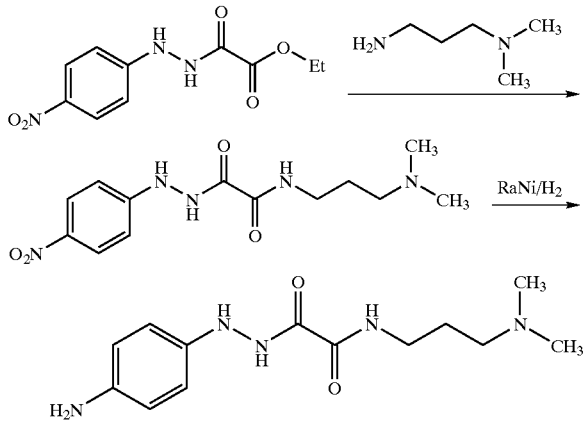

179 g (0.7 mole) of ethyloxalyl-4-nitro-phenylhydrazide were dissolved in 1300 ml of ethanol. 79.3 g (0.78 mole) of 3-(dimethylamino)propylamine in 150 ml ethanol were added and the reaction was allowed to continue for three hours at 50° C. The intermediate (3-dimethylaminopropyl) oxalylamido-4-nitrophenylhydrazide was precipitated from the medium. 700 ml of isopropanol were added to the mixture and the hydrazide was isolated by filtration. The crude hydrazide was treated twice with 300 ml of hexane and dried under reduced pressure. 198 g of (3-dimethylaminopropyl)oxalylamido-4-nitrophenylhydrazide were isolated.

62 g (0.2 mole) of (3-dimethylaminopropyl)oxalylamido-4-nitrophenylhydrazide were dissolved in 423 ml of dimethylacetamide. 32 g (0.40 mole) of pyridine were added and the hydrazide was hydrogenated over Pd/C at 55° C. The hydrogenation was complete within one and a half hour. The catalyst was removed by filtration and the dimethylacetamide solution of intermediate 4 were used as such for further acylation.

precursor hydrazide 2:

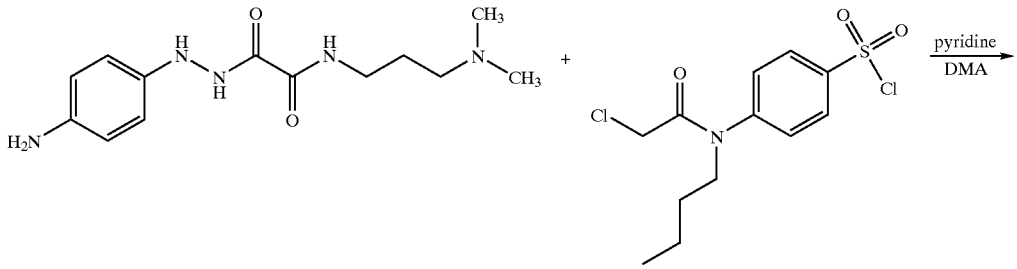

-continued

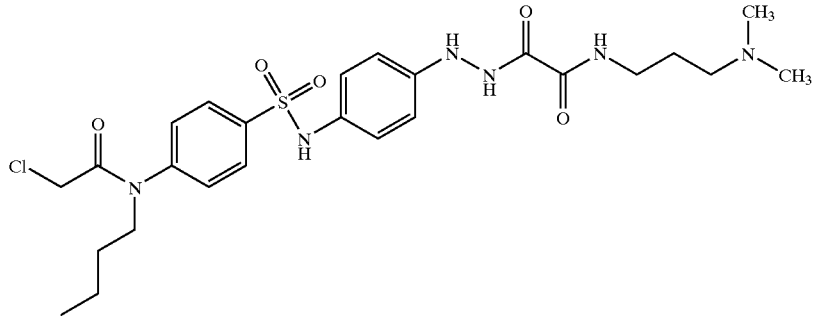

6.48 g (20 mmole) of intermediate 1 were added dropwise to a solution of 5.8 g (20 mmole) of intermediate 4 in dimethylacetamide, obtained after catalytic hydrogenation. The reaction was allowed to continue for 12 hours at room temperature. The intermediate p.sulfonamide hydrazide was used without isolation.

mixture of the p.sulfonamide hydrazide prepared above. The reaction was allowed to continue for 12 hours. The crude hydrazide 5 was precipitated with 1 liter of ethylacetate and purified by preparative column chromatography on Kromasil C18 reversed phase, eluted with methanol/water 70/30. 2.1 g of hydrazide 5 were isolated.

Hydrazide 4

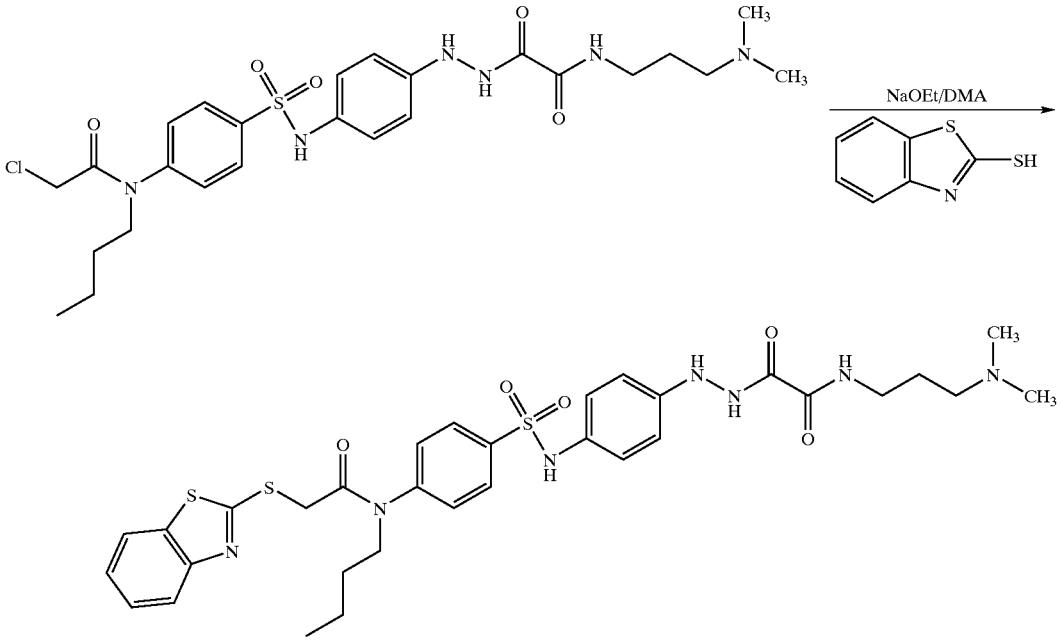

6.7 g (40 mmole) of mercaptobenzothiazole were dissolved in 20 ml of dimethylacetamide. 2.72 g (40 mmole) of NaOEt were added. This solution was added to the reaction Example 5

Hydrazide 4

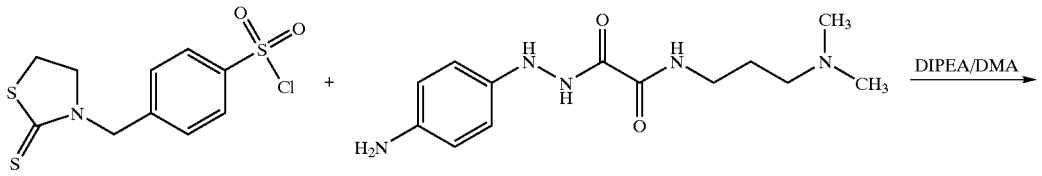

-continued

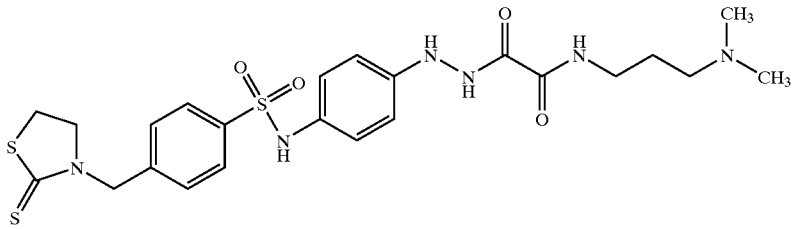

9.3 g (30 mmole) of (3-dimethylaminopropyl) oxalylamido-4-nitrophenylhydrazide were reduced as described above and the mixture was cooled to 5° C. 10 g (32.5 mmole) of intermediate 3, dissolved in 40 ml dimethylacetamide, and 4.2 g (32.5 mmole) of diisopropylethylamine, dissolved in 10 ml of dimethylacetamide, were added drop-wise to the reaction mixture. The reaction was allowed to continue for two hours at room temperature. The reaction mixture was poured into one liter of water and the crude hydrazide 4 was precipitated from the medium as a brown oily compound. Hydrazide 4 was purified by preparative column chromatography on Kromasil C18 100A 10 μm, using MeOH/0.05 M $NaH_2PO_4$ 45/55 as an eluent. 3.5 g of hydrazide 4 were isolated.

Layer arrangement of the coated Mammographic Film Materials:

| Side | Film Material (Invention) |
|---|---|
| Front Layer Unit | Protective layer I<br>Emulsion layer I<br>(cubes)<br>Support* |
| Back Layer Unit | Antihalation layer I<br>Protective layer II |

*thickness: 175 μm blue tinted polyester support

Detailed Description of the Layer Compositions:

Protective layer I (amounts in g/m²):

| | |
|---|---|
| gelatin: | 1.1 |
| polymethyl methacrylate spacing agent (average particle size: 3 μm) | 0.018 |
| chromium acetate: | 0.005 |
| 4-hydroxy-6-methyl-1,3,3a,7-tetraazaindene: | 0.082 |
| $CF_3(CF_2)_6$ $COOH.NH_3$: | 0.007 |
| $CF_3(CF_2)_6$ CONH $(CH_2CH_2O)_{17-20}$ : | 0.019 |
| Phenol: | 0.003 |
| Mobilcer Q (a paraffin wax, trade name product from MOBIL OIL): | 0.025 |
| formaldehyde (added just before coating): | 0.18 |
| Product (number added to the Table 1, indicative for the hydrazide compound added to the protective layer (expressed in mmoles per g $AgNO_3$). | |

Protective layer II (amounts in g/m²):

| | |
|---|---|
| gelatin: | 0.56 |
| $CF_3(CF_2)_6$ $COOH.NH_3$: | 0.002 |
| glyoxal: | 0.17 |
| polymethyl metacrylate particles (av. part. size: 7 μm): | 0.023 |

Emulsion layer I (amounts in g/m²):

| | |
|---|---|
| AgBr(I) emulsion having cubic grains*(1 mole % AgI/99 mole % AgBr) in weight amount expressed as equivalent amount of $AgNO_3$ | 6.8 |

-continued

| | |
|---|---|
| gelatin: | 2.56 |
| 5,5'-dichloro-3,3'-bis(n-propyl-4-sulphonate)-ethylbenzoxacarbocyanine (anhydrous triethylammonium salt) | 0.014 |
| 4-hydroxy-6-methyl-1,3,3a,7-tetraazaindene | 0.029 |
| sorbitol | 0.45 |
| polyethylacrylate, latex as a plasticizer | 0.45 |
| resorcinol | 0.10 |
| potassium bromide | 0.007 |
| dextran (M.W. = 10000) | 1.50 |

*cubic crystals having mean grain size (edge length) of 0.70 μm (average diameter, calculated from spheres having equivalent volume; precipitation and chemical ripening described below)

Antihalation Layer I (Amounts Expressed in g/m²):

gelatin 1.4 dye II (dye according to the formula given hereinafter in form of a dispersion having average particle size of 1 μm) being decolorized in the processing solution: 0.190

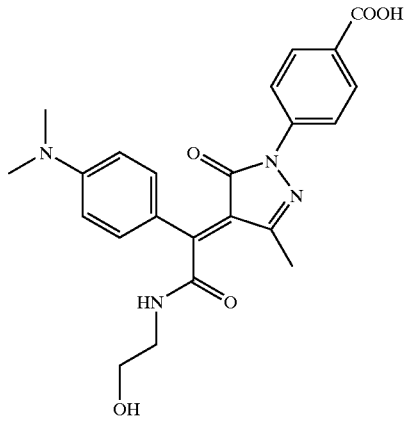

Preparation of AgBr(I) Cubic Grain Emulsion (0.70 μm)

Precipitation Scheme:

To 1 l of a solution, containing 15 g of methionine and 50 g of gelatin, adjusted to a pH of 5.8, were added, at 60° C., by double jet addition, a 2.94 M solution of $AgNO_3$ at a constant flow rate of 5.7 ml/min during 5 minutes and a solution of a mixture of 2.91 M of KBr and 0.03 M of KI at a flow rate controlled in order to maintain pAg constant at 7.8.

Then the flow rate of the $AgNO_3$ solution was increased linearly up to 21 ml/min during 72 minutes and 46 seconds. Cubic grains thus prepared having as a composition 99 mole % AgBr and 1 mole % AgI, based on silver, showed an average grain size (edge length, calculated from equivalent sphere volumes) of 0.70 μm.

Chemical Ripening Conditions:

At a pH of 6.0, optimized amounts of sodium thiosulphate, chloro auric acid, ammonium thiocyanate, sodium toluene thiosulphonate and sodium sulphite were added in order to provide the best available fog/speed ratio.

Exposure and Processing Conditions:

Samples of Film Materials the layer arrangement of which has been given hereinbefore, were identically exposed from the front-side with green light (filter Corning 4010) during 2.0 seconds, making use of a continuous wedge.

The samples were processed in a CURIX 530®, tradename of Agfa-Gevaert N.V., automatic processing machine.

Processing sequence and conditions in the said CURIX 530® processing machine were following (expressed in seconds (sec.), temperature (in ° C.) added thereto:

| | |
|---|---|
| loading | 3.4 sec. |
| developing | 23.4 sec./35° C. in developer |
| cross-over | 3.8 sec. |
| fixing | 15.7 sec./35° C. in fixer G334 ® |
| cross-over | 3.8 sec. |
| rinsing | 15.7 sec./20° C. |
| drying | 32.2 sec. (cross-over time included) |
| total time | 98.0 sec. |

Samples of the film materials were processed in G138®: a glutaraldehyde containing hydroquinone/1-phenyl-3-pyrazolidine-1-one("phenidone") developer marketed by Agfa-Gevaert N.V., further containing nitro-indazol(no benzimidazol), in an amount of 0.25 g per liter.

Determination of Dmin, Contrast (Gradation) and Speed (Sensitivity):

After exposure and processing under the above described circumstances the optical density as a function of exposure dose was measured and Dmin, speed and contrast were determined as follows:

(i) Dmin: density "D" at a non-exposed part of the sample, minus density of the undercoat layer.

(ii) Speed "S": log E(xposure) value at density value of 1.4+Dmin.

(iii) Average gradient "GG": determined as 1.75/((log E at density D=2.00+Dmin)—(log E at density D=0.25+Dmin))

Results:

Table 1 hereinafter shows values of "Dmin", speed "Relative Speed" at D=1.00 above fog level (taking "100" for the comparative without a hydrazide additive as standard value), "Relative gradient" (taking "100" between D=0.25 and D=2.00 above fog level for the comparative without a hydrazide additive as standard value). Amounts of hydrazides (mmole per gram of silver nitrate) and hydrazide product (taken from the list presented hereinbefore) have been added in the columns 2 and 3 of the Table 1.

TABLE 1

| Film Matl. No. | Product | Concentration in mmole/g of $AgNO_3$ | Dmin | Relative speed* | Relative gradient** |
|---|---|---|---|---|---|
| 1 (comp) | NO | 0 | 0.200 | 100 | 100 |
| 2 (inv.) | R | 0.017 | 0.202 | 105 | 113 |
| 3 (inv.) | D | 0.013 | 0.232 | 309 | 185 |
| 4 (inv.) | A | 0.017 | 0.198 | 102 | 106 |
| 5 (inv.) | C | 0.001 | 0.196 | 141 | 146 |
| 6 (inv.) | S | 0.0004 | 0.198 | 102 | 103 |
| 7 (inv.) | T | 0.004 | 0.198 | 102 | 103 |
| 8 (inv.) | U | 0.004 | 0.201 | 102 | 103 |
| 9 (inv.) | V | 0.004 | 0.197 | 102 | 104 |
| 10 (inv.) | W | 0.004 | 0.200 | 102 | 105 |
| 11 (inv.) | X | 0.004 | 0.199 | 105 | 108 |
| 12 (inv.) | B | 0.001 | 0.201 | 129 | 131 |
| 13 (inv.) | Y | 0.001 | 0.201 | 110 | 107 |
| 14 (inv.) | E | 0.017 | 0.200 | 123 | 119 |
| 15 (inv.) | Z-1 | 0.017 | 0.203 | 100 | 103 |
| 16 (inv.) | Z-2 | 0.017 | 0.204 | 100 | 101 |

*at D = 1.00 above fog level

**between D = 0.25 and D = 2.00 above fog level

A photographic material having a large dynamic range, a high speed and a high contrast of more than 4.0 and, more preferably even more than 4.5, so that lesions deep in the glandular tissue are accurately detected, has thus been provided: as can be concluded from the results in the Table 1, depending on the choice of the hydrazide compound and on its concentration (as herein in the range from $1\times10^{-3}$ to $2\times10^{-2}$ mmole/g), an enhanced speed and gradation is attained without having a detrimental influence on fog level.

Having described in detail preferred embodiments of the current invention, it will now be apparent to those skilled in the art that numerous modifications can be made therein without departing from the scope of the invention as defined in the appending claims.

What is claimed is:

1. Single-side coated silver halide photographic film material, comprising a support, at least one light-sensitive emulsion layer and a substantially light-insensitive protective hydrophilic colloid layer farther away from said support than said emulsion layer, wherein said emulsion layer contains a silver halide emulsion rich in silver bromide with cubic crystals having an average numerical diameter in the range from 0.4 up to 0.8 $\mu$m, wherein at least 95 mole % of bromide ions are present, and wherein said hydrophilic colloid layer or another substantially light-insensitive hydrophilic colloid layer comprises a hydrazide represented by the general formula (I):

(I)

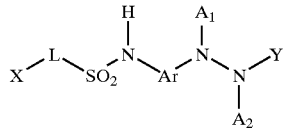

wherein in the general formula (I) Y is selected from the group consisting of

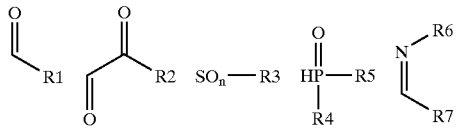

wherein $R^1$ to $R^7$ is selected from the group consisting of hydrogen, $NR^8R^9$, $OR^{10}$, $SR^{11}$, an aliphatic group, an aromatic group, and a heteroaromatic group, and wherein $R^8$ to $R^{11}$ each independently represents a member selected from the group consisting of hydrogen, an aliphatic group, an aromatic group, a heteroaromatic group and wherein $R^4$ and $R^5$, $R^6$ and $R^7$ and $R^8$ and $R^9$ respectively may have the necessary atoms in order to form a ring;

n equals an integer having a value of 1 or 2;

$A_1$ and $A_2$ each independently represents hydrogen, a group capable of yielding a hydrogen upon alkaline hydrolysis, or $R^{12}SO_2$, provided that, if $A_1$ represents $R^{12}SO_2$, $A_2$ represents hydrogen or vice versa, that $R^{12}$ represents an aliphatic group, an aromatic group, a heteroaromatic group; and that further Ar represents an aromatic or heteroaromatic group;

L represents a divalent linking group; and X represents a silver halide adsorptive group or a group capable of yielding a silver halide adsorptive group upon processing.

2. Material according to claim 1, wherein said hydrazide is represented by general formula (II):

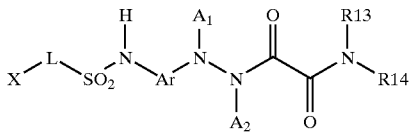

(II)

wherein $R^{13}$ and $R^{14}$ are independently selected from the group consisting of a hydrogen, an aliphatic group, an aromatic group, a heteroaromatic group and wherein $R^{13}$ and $R^{14}$ may represent the necessary atoms to form a ring;

$A_1$ and $A_2$ each independently represents hydrogen, a group capable of yielding hydrogen upon alkaline hydrolysis or $R^{12}SO_2$, provided that if $A_1$ represents $R^{12}SO_2$, $A_2$ represents hydrogen or vice versa;

$R^{12}$ represents an aliphatic group, an aromatic group, a heteroaromatic group;

Ar represents an aromatic or heteroaromatic group;

L represents a divalent linking group; and

X represents a silver halide adsorptive group or a group capable of yielding a silver halide adsorptive group upon processing.

3. Material according to claim 1, wherein in the general formula (I) each of $A_1$ and $A_2$ represents hydrogen.

4. Material according to claim 2, wherein in the general formula (II) each of $A_1$ and $A_2$ represents hydrogen.

5. Material according to claim 2, wherein in the formula (II) at least one of $R^{13}$ and $R^{14}$ represents an aliphatic group containing a hydroxyl or an amino group.

6. Material according to claim 4, wherein in the formula (II) at least one of $R^{13}$ and $R^{14}$ represents an aliphatic group containing a hydroxyl or an amino group.

7. Material according to claim 1, wherein in the general formula (I) X represents a heterocyclic thion.

8. Material according to claim 2, wherein in the general formula (II) X represents a heterocyclic thion.

9. Material according to claim 3, wherein in the general formula (I) X represents a heterocyclic thion.

10. Material according to claim 4, wherein in the general formula (II) X represents a heterocyclic thion.

11. Material according to claim 5, wherein in the general formula (II) X' represents a heterocyclic thion.

12. Material according to claim 6, wherein in the general formula (II) X represents a heterocyclic thion.

13. Material according to claim 1, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

14. Material according to claim 2, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

15. Material according to claim 7, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

16. Material according to claim 8, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

17. Material according to claim 9, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

18. Material according to claim 10, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

19. Material according to claim 11, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

20. Material according to claim 12, wherein only one light-sensitive layer is present and wherein said protective antistress layer and said light-sensitive emulsion layer are each water-permeable hydrophilic layers, hardened up to a swelling degree of less than 200%, and wherein said light-sensitive silver halide emulsion layer is coated with cubic silver bromoiodide grains having silver iodide in a molar amount of at most 1 mole %, said grains having a coefficient of variation of grain diameter of less than 20%.

21. Material according to claim 1, wherein said material is a mammographic material.

22. Material according to claim 2, wherein said material is a mammographic material.

23. Material according to claim 7, wherein said material is a mammographic material.

24. Material according to claim 8, wherein said material is a mammographic material.

25. Material according to claim 9, wherein said material is a mammographic material.

26. Material according to claim 10, wherein said material is a mammographic material.

27. Material according to claim 11, wherein said material is a mammographic material.

28. Material according to claim 12, wherein said material is a mammographic material.

29. Material according to claim 13, wherein said material is a mammographic material.

30. Material according to claim 14, wherein said material is a mammographic material.

31. Material according to claim 15, wherein said material is a mammographic material.

32. Material according to claim 16, wherein said material is a mammographic material.

33. Material according to claim 17, wherein said material is a mammographic material.

34. Material according to claim 18, wherein said material is a mammographic material.

35. Material according to claim 19, wherein said material is a mammographic material.

36. Material according to claim 20, wherein said material is a mammographic material.

37. Method of forming a diagnostic image comprising the steps of providing a single-side coated photographic film material according to claim 1;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

38. Method of forming a diagnostic image comprising the steps of providing a single-side coated photographic film material according to claim 2;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

39. Method of forming a diagnostic image comprising the steps of providing a single-side coated photographic film material according to claim 7;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

40. Method of forming a diagnostic image comprising the steps of providing a single-side coated photographic film material according to claim 8;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

41. Method of forming a diagnostic image comprising the steps of providing a single-side coated photographic film material according to claim 9;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

42. Method of forming a diagnostic image comprising the steps of providing a single-side coated photographic film material according to claim 10;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

43. Method of forming a diagnostic image comprising the steps of providing a single-side coated photographic film material according to claim 11;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

44. Method of forming a diagnostic image comprising the steps of providing a single-side coated photographic film material according to claim 12;

contacting said photographic film with an intensifying screen, forming a film/screen assembly, and exposing said assembly to x-ray radiation with an energy lower than or equal to 70 kVp, processing said film material during a time of 90 seconds or less in a processing cycle following the steps of developing, fixing, rinsing and drying, and wherein the developing proceeds in a radiographic developer composition essentially comprising a hydroquinone and a 1-phenyl-3-pyrazolidine-1-one compound as a developing agents and a heteroatomic nitro-indazol.

45. Use of a material according to claim 1, for obtaining diagnostic images in medical applications, for images of an object under investigation in low voltage imaging environments and for industrial radiography of low-density structures.

46. Use of a material according to claim 1, for obtaining mammographic diagnostic images.

* * * * *

UNITED STATES PATENT AND TRADEMARK OFFICE

CERTIFICATE OF CORRECTION

PATENT NO. : 6,733,947 B2
DATED : May 11, 2004
INVENTOR(S) : De Bie et al.

It is certified that error appears in the above-identified patent and that said Letters Patent is hereby corrected as shown below:

Title page,
Item [30], Foreign Application Priority Data, should read
-- Jul. 5, 2002 (EP) ……. 021 00786 --

Signed and Sealed this

Ninth Day of November, 2004

JON W. DUDAS
*Director of the United States Patent and Trademark Office*